US009938907B2

(12) United States Patent
Hellemann

(10) Patent No.: US 9,938,907 B2
(45) Date of Patent: Apr. 10, 2018

(54) METHOD AND ENGINE BRAKE SYSTEM TO CONTROL AN ENGINE BRAKE OF A VEHICLE

(75) Inventor: Fabian Hellemann, Göteborg (SE)

(73) Assignee: Volvo Lastvagnar AB, Göteborg (SE)

( * ) Notice: Subject to any disclaimer, the term of this patent is extended or adjusted under 35 U.S.C. 154(b) by 419 days.

(21) Appl. No.: 14/386,380

(22) PCT Filed: Apr. 25, 2012

(86) PCT No.: PCT/EP2012/001774

§ 371 (c)(1),
(2), (4) Date: Sep. 19, 2014

(87) PCT Pub. No.: WO2013/159788

PCT Pub. Date: Oct. 31, 2013

(65) Prior Publication Data

US 2015/0047601 A1 Feb. 19, 2015

(51) Int. Cl.
*F02D 9/02* (2006.01)
*F02D 9/06* (2006.01)
(Continued)

(52) U.S. Cl.
CPC ..... *F02D 9/06* (2013.01); *F01L 13/06* (2013.01); *F02D 9/02* (2013.01); *F02D 41/1448* (2013.01);
(Continued)

(58) Field of Classification Search
CPC ..... F02D 9/06; F02D 41/1448; F02D 9/02; F02D 2009/0242; F02D 2009/023; F01L 13/06
See application file for complete search history.

(56) References Cited

U.S. PATENT DOCUMENTS 4,973,896 A * 11/1990 Shiga ..... H02J 7/1438 290/40 C
5,086,889 A * 2/1992 Nobumoto ..... F16H 61/143 192/3.31
(Continued)

FOREIGN PATENT DOCUMENTS

DE 10329022 A1 1/2005
FR 2937296 A1 * 4/2010 ..... B60K 28/16

OTHER PUBLICATIONS

International Search Report (dated Feb. 7, 2013) for corresponding International Application PCT/EP2012/001774.

*Primary Examiner* — David Hamaoui
(74) *Attorney, Agent, or Firm* — WRB-IP LLP

(57) ABSTRACT

A method and system to control an engine brake of a vehicle is provided. The vehicle is provided with a combustion engine having cylinders, an exhaust pressure governor (EPG) regulating the air flow out of the cylinders, an intake air throttle valve (ITV) regulating the air flow into the cylinders, pressure sensing means for sensing a pressure downstream of the cylinders, wherein an engine braking torque can be regulated in two different engine braking modes (a, b), •a first engine braking mode (a), in which the air flow through the EPG is regulated by a closed loop control using the pressure downstream of the cylinders and the ITV is regulated in a feed forward control dependent of the engine speed and a demanded brake torque; •a second engine braking mode (b), in which the EPG is regulated in a feed forward control dependent of the engine speed and the demanded brake torque, and the ITV regulates the braking torque by a closed loop control using the pressure downstream of the cylinders.

10 Claims, 2 Drawing Sheets

(51) Int. Cl.
*F02D 41/14* (2006.01)
*F01L 13/06* (2006.01)

(52) U.S. Cl.
CPC ..... *F02D 2009/023* (2013.01); *F02D 2009/0242* (2013.01)

(56) References Cited

U.S. PATENT DOCUMENTS

| | | | | |
|---|---|---|---|---|
| 5,261,236 | A * | 11/1993 | Ironside | F02D 41/0007 123/399 |
| 6,931,837 | B2 * | 8/2005 | Verkiel | F02D 41/0002 123/399 |
| 7,631,552 | B2 * | 12/2009 | Keski-Hynnila | G01M 15/05 73/114.74 |
| 8,567,192 | B2 * | 10/2013 | Chi | F02B 37/18 123/562 |
| 2002/0174849 | A1 * | 11/2002 | Ruggiero | F01L 13/06 123/319 |
| 2010/0122687 | A1 | 5/2010 | Gerum et al. | |
| 2010/0258080 | A1 | 10/2010 | Andrasko et al. | |
| 2011/0093182 | A1 * | 4/2011 | Weber | F02D 41/0007 701/102 |

* cited by examiner

METHOD AND ENGINE BRAKE SYSTEM TO CONTROL AN ENGINE BRAKE OF A VEHICLE

BACKGROUND AND SUMMARY

The present invention relates to the field of engine brakes of a vehicle. Especially for a vehicle provided with a combustion engine having cylinders with cylinder valves an exhaust pressure governor (EPG) regulating the air flow out of the cylinders and an intake air throttle valve (ITV) regulating the air flow into the cylinders.

Engine brakes which comprise a compression brake and an exhaust pressure governor (EPG) are known. The compression brake closes the cylinders valves, such that the air therein is compressed, whereby a brake torque is created. Normally, the compression brake is controlled by an on/off valve.

The EPG controls the pressure downstream of the cylinders, wherein a closing of the EPG usually leads to a higher exhaust manifold pressure, thereby a higher engine brake torque. The EPG is usually controlled with a closed-loop control with the exhaust pressure as feedback signal.

The total engine brake torque is a combination of the brake torque contribution from the compression brake and the EPG.

The inputs to a controller of the compression brake are the demanded exhaust pressure and the actual exhaust pressure. The output from the controller of the compression brake is a control signal that controls the movement of the EPG. During engine braking, the exhaust pressure is proportional to the engine brake torque and is therefore used to indirectly control the engine brake torque.

For some engines, especially turbo compound engines, and at some engine speeds, it is not possible to control the brake torque contribution from the compression brake between a zero brake torque contribution from the compression brake when it is deactivated and the maximum brake torque contribution from the compression brake that can be achieved with the compression brake activated. Due to the fact that the compression brake is activated by an ON/Off valve, continuous control of engine brake torque is not possible between the maximum torque that can be reached with only the EPG and the torque that is reached with the compression brake only.

Hence, during some conditions, the engine brake torque regulation cannot be regulated indefinitely or in small discrete steps, instead just in an on/off mode, due to the on/off regulation of the compression brake.

There is thus a need for an improved regulation of a vehicles engine brake, which removes the above mentioned disadvantage.

It is desirable to provide an inventive method to control an engine brake of a vehicle, wherein said method facilitates better control possibilities of the engine brake.

The inventive method to control an engine brake of a vehicle is adapted for a vehicle provided with a combustion engine having;

cylinders allowing a compression braking therewith, an exhaust pressure governor (EPG) regulating the air flow out of the cylinders, an intake air throttle valve (ITV) regulating the air flow into the cylinders, and pressure sensing means for sensing a pressure downstream of the cylinders.

The engine brake of said vehicle is adapted to be regulated in two different engine brake modes;

a first engine brake mode, in which the air flow through the EPG is regulated by a closed loop control using said pressure downstream of the cylinders and the ITV is regulated in a feed forward control dependent of the engine speed and a demanded brake torque, and a second engine brake mode, in which the EPG is regulated in a feed forward control dependent of the engine speed (S) and the demanded brake torque (T), and the ITV regulates the braking torque by a closed loop control using said pressure downstream of the cylinders.

When the ITV is regulated such that the intake air mass flow in the cylinders of the engine is decreased, the braking torque contribution from the compression brake is decreased. An infinite or discrete regulation of the compression brake can thereby be achieved.

Because both the engine brake modes regulates the braking torque with a closed loop control against the pressure downstream of the cylinders a smooth transition between the two different engine brake modes is facilitated.

In the first regulation mode, the EPG is regulated dependent of the sensed pressure downstream of the cylinders, wherein the ITV is regulated in a feed forward control dependent of the engine speed and a demanded brake torque. The position of the ITV is recalled from a two-dimensional map or a list having the engine speed and the demanded brake torque as input signals. The map or list is preferably predetermined and stored in the engine brake controller.

In the second regulation mode, the EPG is regulated in a feed forward control dependent of the engine speed and demanded brake torque. The ITV regulates the braking torque in direct dependency of the sensed pressure downstream of the cylinders. The position of the EPG is recalled from a two-dimensional map or a list having the engine speed and the demanded brake torque as input signals. As before, the map or list is preferably predetermined and stored in the engine brake controller. The second regulation mode is used if the EPG is already completely open and less torque/exhaust pressure is requested, wherein this regulation has to be done with the ITV, whereby the engine brake can be more exact regulated over a greater torque span.

A determination of which of the first and the second engine braking mode that should be used is dependent on a demanded braking torque and an actual engine speed, thereby can always the optimal braking torque regulation be used for all situations of operation of the engine.

It is preferred that the sensing means for sensing a pressure downstream of the cylinders, senses the exhaust manifold pressure from the cylinders. Existing pressure sensors for sensing the exhaust manifold pressure from the cylinders can thereby be used without any additional cost.

It is preferred that the second braking mode is used when a demanded brake torque is below a brake torque threshold value, or an actual engine speed is above an engine speed threshold value. At high engine speeds, an activation of the compression brake gives very high braking torque, where by limit values of the engine can be exceeded, i.e. exhaust temperature, pressure differences over exhaust valves, etc, by controlling the engine brake in the second mode this can be avoided, in that the brake torque is reduced using the ITV.

The second brake mode is also preferred at lower engine speeds and a low brake torque demands.

It is further preferred that said first brake mode is used when a demanded engine brake torque is above an engine brake torque threshold value and an actual engine speed is below an engine speed threshold value. The highest brake torque is achieved when both the EPG and the compression brake is controlled to deliver a maximum brake torque.

It is further preferred that a switching from said second braking mode to said first braking mode is done, when the demanded braking torque increases above an engine braking torque threshold value and the engine speed is below an engine speed threshold value.

It is further preferred that a switching from said first braking mode to said second braking mode is done, when the demanded braking torque is decreasing below an engine torque threshold value, or when the actual engine speed increases above an engine speed threshold value, or when the EPG is completely open and the demanded exhaust manifold pressure is lower than an actual exhaust manifold pressure, or when an EPG actuator failure occurs. An optimal regulation of the braking torque is thereby achieved for all operation conditions of the engine.

It is further preferred that said engine is equipped with a charge air cooler bypass valve (CAC-valve), whereby during engine braking said CAC-valve can be controlled to increase or decrease said exhaust manifold pressure. The CAC-valve can be regulated in the same exact manner, and is suitable to regulate against the pressure downstream of the cylinders, e.g. the exhaust manifold pressure. Thereby can an engine brake controller choose to regulate the air mass flow into the cylinders with either the CAC-valve or the ITV. The temperature of the exhaust gas can thereby be regulated, which is important in order to achieve high enough temperatures for the exhaust gas after treatment system.

It is further preferred that said engine torque threshold value comprises a first and a second engine torque threshold value, wherein said first engine torque threshold value is lower than said second engine torque threshold value, and said engine speed threshold value comprises a first and a second engine speed threshold value, wherein said first engine speed threshold value is lower than said second engine speed threshold value, wherein said first threshold values are used when the reference value increases and the second threshold value are used when the reference value decreases. By using a hysteresis function as described above, unnecessary switching between the two modes of regulation are avoided in the bounder areas.

It is further preferred that said first engine torque threshold value is dependent of the engine speed.

The invention also relates to an engine brake system for a vehicle, where a control unit is arranged to perform said method steps.

BRIEF DESCRIPTION OF THE DRAWINGS

The present invention will now be described in detail with reference to the figures, wherein.

DETAILED DESCRIPTION

In the following only one embodiment of the invention is shown and described, simply by way of illustration of one node of carrying out the invention. The invention is not limited to the specific diagrams presented, but includes all variations within the scope of the present claims.

Reference signs mentioned in the claims should not be seen as limiting the extent of the matter protected by the claims, and their sole function is to make claims easier to understand.

Figure 1:
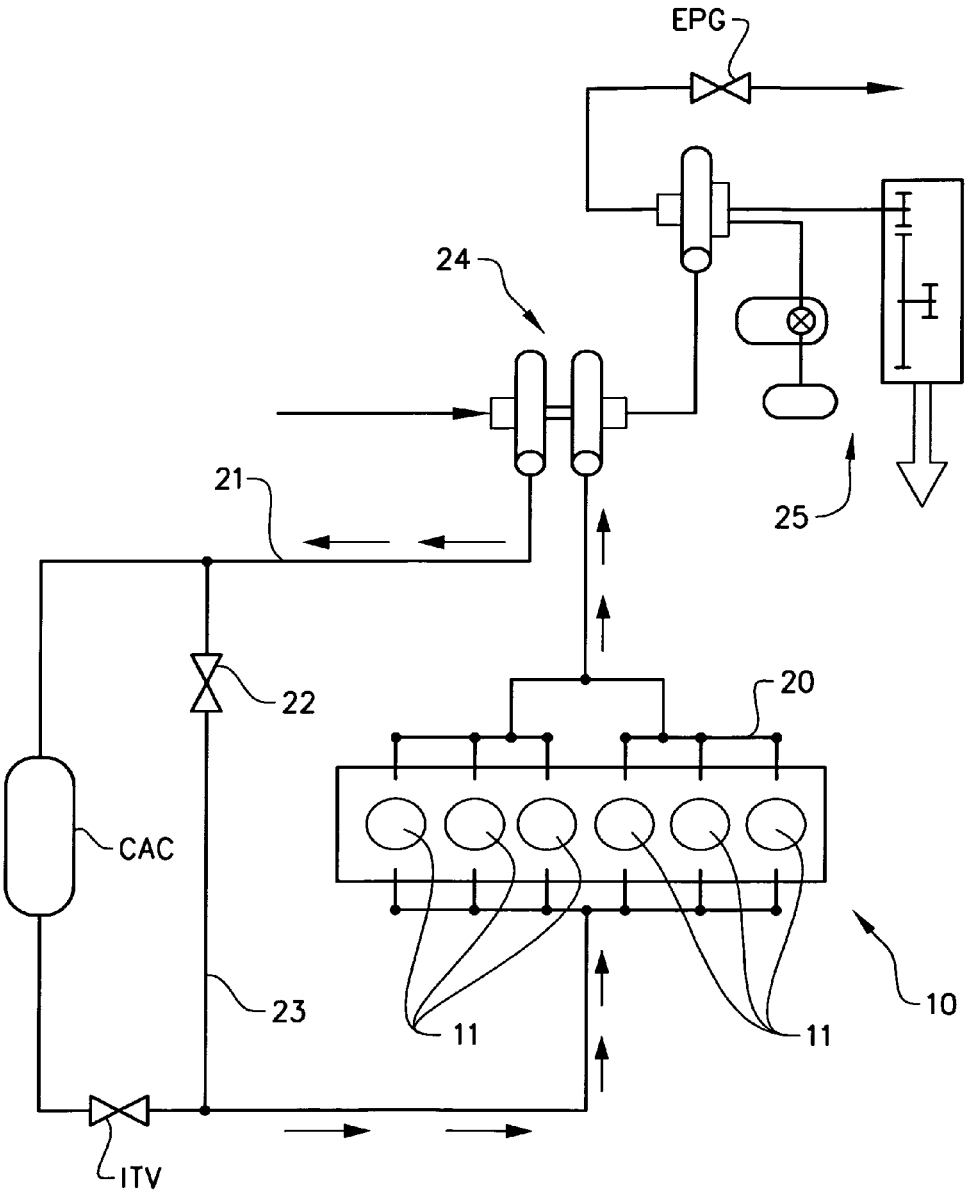
FIG. 1 shows a schematic drawing of an engine and its inlet and exhaust gas system.

FIG. 1 shows a schematic view of an engine (10) and its air intake and exhaust gas flows, in FIG. 1 is only flows relevant for the invention disclosed. The engine (10) comprises six cylinders (11), the number of cylinders is however not important for the invention. The air intake flow is regulated by an intake air throttle valve (ITV) arranged in the air intake channel (21). A charge air cooler (CAC) is arranged upstream in the intake air flow, the CAC is able to cool the intake air flow. A CAC bypass-valve (22) is arranged upstream of the CAC, such that the intake air flow can bypass the CAC through the CAC bypass-valve (22). The CAC bypass-valve (22) leads to a bypass channel (23), which joints with the air intake channel (21) downstream of the ITV. In the FIG. 1 is also a turbo component 24 disclosed. The turbo component 24 obviously influences the specification of the whole engine system, does however not influence the inventive control modes. The invention is applicable to an engine with or without a turbo component 24. Further in FIG. 1 is also auxiliary devices 25 disclosed. The auxiliary devices 25 obviously influences the specification of the whole engine system, does however not influence the inventive control modes. The invention is applicable to an engine with or without a turbo component 25.

Figure 2:
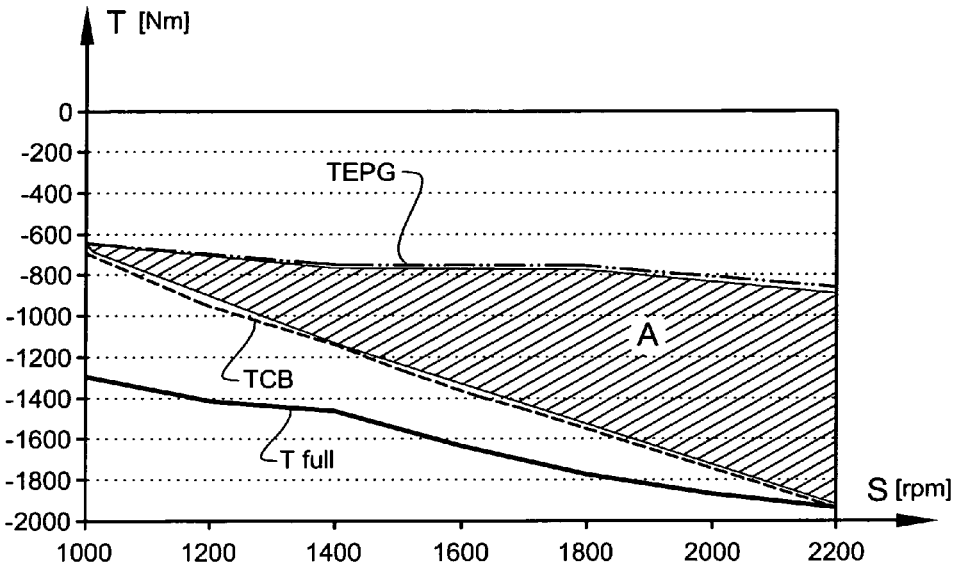
FIG. 2 shows a schematic diagram of the available engine braking torque.

FIG. 2 discloses a characteristic diagram showing a relationship between engine braking torque (Nm) and rotational speed (rpm) of the engine (10). The upper curve (TEPG) discloses the braking torque (T) achieved with just the EPG activated. The middle curve (TCB) discloses the minimum braking torque (T) that can be achieved with the EPG and the compression brake activated, i.e. the EPG is regulated to deliver its minimum contribution to the total braking torque. The lowest curve (Tfull) discloses the maximum braking torque deliverable by the engine brake. With a control method according to the prior art, the area (A) between the upper (TEPG) and the middle (TCB) corresponds to none adjustable engine brake area (A). Due to the inventive engine brake modes (a, b) of the ITV for controlling the braking torque of the compression brake, the engine brake is adjustable within a large part of this area.

By throttling the air flow into the cylinders (11) of the combustion engine (10) a smaller amount of air mass is compressed in the cylinders (11) during engine braking, and thereby is less braking torque developed. A decreased braking torque contribution from the compression brake is thereby achieved. An infinite or discrete regulation of the total braking torque (T) is available within the whole available braking torque area.

Figure 3:
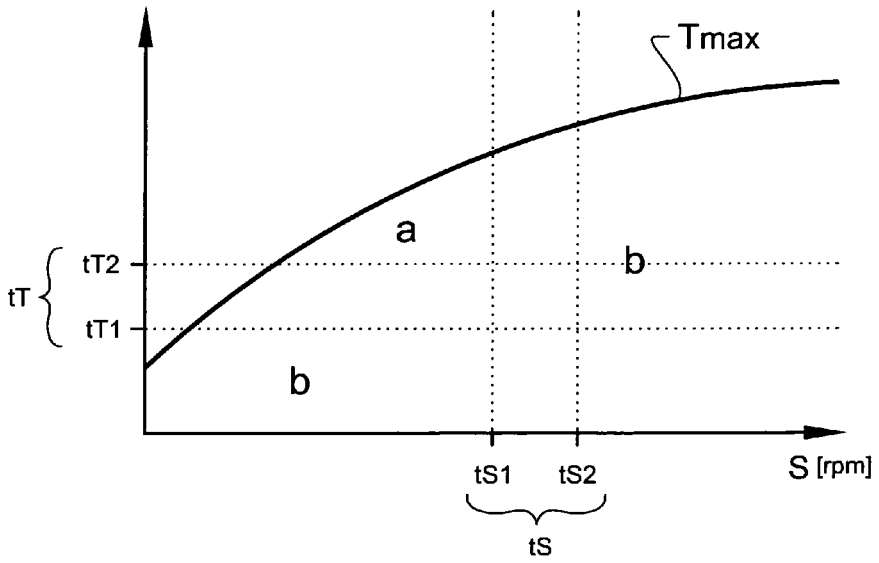
FIG. 3 shows a diagram over the inventive regulation modes of the engine torque.

FIG. 3 discloses a schematic diagram of the control between the first and the second engine brake mode a, b. The only curve Tmax discloses the maximum braking torque at different engine speeds S. The two vertical lines tS1 tS2 represent the engine speed threshold values S at which a switch from braking mode a to braking mode b is actuated and at which a switch from braking mode b to braking mode a is actuated respectively. The two horizontal lines tT1, tT2 represent the engine braking torque threshold values T at which a switch from braking mode b to braking mode a is actuated and at which a switch from braking mode a to braking mode b is actuated respectively, at engine speeds below the engine speed threshold value tS. The actual braking torque threshold values can however vary with the engine speed.

Having different values tS1, tS2, tT1 and tT2 for decreasing and for increasing actual respectively demanded speed (S) and torque (T) values and decreasing, actual respectively demanded speed (S) and torque (T) values, minimises the risk for unnecessary switching between the different engine brake modes.

A not disclosed control unit is arranged to perform the method steps according to the different embodiments.

As will be realised, the invention is capable of modification in various obvious respects, all without departing from the scope of the appended claims. Accordingly, the drawings and the description thereto are to be regarded as illustrative in nature, and not restrictive.

The invention claimed is:

1. A method to control an engine brake of a vehicle, the vehicle being provided with a combustion engine having cylinders, an exhaust pressure governor (EPG) regulating the air flow out of the cylinders, an intake air throttle valve (ITV) regulating the air flow into the cylinders, and pressure sensing means for sensing a pressure downstream of the cylinders, the method comprising regulating an engine braking torque in a first engine braking mode (a), in which the air flow through the EPG is regulated by a closed loop control using the pressure downstream of the cylinders and the ITV is regulated in a feed forward control dependent of the engine speed and a demanded brake torque;

regulating the engine braking torque in a second engine braking mode (b), in which the EPG is regulated in a feed forward control dependent of the engine speed and the demanded brake torque, and the ITV regulates the braking torque by a closed loop control using the pressure downstream of the cylinders; and determining which of the first and the second engine braking mode (a, b) should be used based on a demanded braking torque and an actual engine speed.

2. The method according to claim 1, comprising sensing exhaust manifold pressure from the cylinders via the sensing means for sensing a pressure downstream of the cylinders.

3. The method according to claim 1, wherein a determination to use the second braking mode (b) is at least partially based on whether a demanded braking torque is below a braking torque threshold value, or an actual engine speed is above an engine speed threshold value.

4. The method according to claim 3, wherein a determination to use the first braking mode (a) is at least partially based on whether a demanded engine braking torque is above an engine torque threshold value and an actual engine speed is below an engine speed threshold value.

5. The method according to claim 4, comprising switching from the second braking mode (b) to the first braking mode (a)

when the demanded braking torque increases above an engine torque threshold value and the engine speed is below an engine speed threshold value, or when the actual braking torque is above an engine torque threshold value and the engine speed is increasing above the engine speed threshold value.

6. The method according to claim 4, comprising switching from the first braking mode (a) to the second braking mode (b)

when the demanded braking torque is decreasing below an engine torque threshold value, or when the actual engine speed is increased above an engine speed threshold value, or when the EPG is completely open and the demanded exhaust manifold pressure is lower than an actual exhaust manifold pressure, or when an EPG actuator failure occurs.

7. The method according to claim 4, wherein the engine torque threshold value comprises a first and a second engine torque threshold value, wherein the first engine torque threshold value is lower than the second engine torque threshold value, and the engine speed threshold value comprises a first and a second engine speed threshold value, wherein the first engine speed threshold value is lower than the second engine speed threshold value, wherein the first engine torque and engine speed threshold values are used when a respective value of the first engine torque and engine speed threshold values decreases and the second engine torque and engine speed threshold value are used when the respective value of the first engine torque and engine speed threshold values increases.

8. The method according to claim 7, wherein the first engine torque threshold value is dependent of the engine speed.

9. The method according to claim 1, wherein the engine is equipped with a charge air cooler bypass valve (CAC), the method comprising controlling the CAC to increase or decrease the exhaust manifold pressure.

10. An engine brake system for a vehicle, comprising a control unit arranged to perform the method steps of claim 1.

* * * * *